US006189282B1

(12) United States Patent
VanderWerf

(10) Patent No.: US 6,189,282 B1
(45) Date of Patent: Feb. 20, 2001

(54) MORTARLESS CONCRETE BLOCK

(75) Inventor: Pieter A. VanderWerf, Stoughton, MA (US)

(73) Assignee: Building Works, Inc., Cambridge, MA (US)

( * ) Notice: Under 35 U.S.C. 154(b), the term of this patent shall be extended for 0 days.

(21) Appl. No.: 09/227,250

(22) Filed: Jan. 8, 1999

Related U.S. Application Data

(60) Provisional application No. 60/099,144, filed on Sep. 4, 1998, and provisional application No. 60/090,438, filed on Jun. 24, 1998.

(51) Int. Cl.[7] ..... E04B 2/00

(52) U.S. Cl. ..... 52/582.1; 52/605; 52/586.1; 52/585.1; 52/586.2

(58) Field of Search ..... 52/582.1, 586.1, 52/585.1, 605, 586.2; 446/122, 111

(56) References Cited

U.S. PATENT DOCUMENTS

| | | | | |
|---|---|---|---|---|
| 727,862 | * | 5/1903 | Taylor | 52/586.1 |
| 1,567,085 | * | 12/1925 | Rowland | 52/605 |
| 1,657,441 | | 1/1928 | Huovinen . | |
| 1,995,477 | * | 3/1935 | Kotrbaty | 52/586.2 |
| 2,141,397 | | 12/1938 | Locke . | |
| 2,225,612 | * | 12/1940 | Allen | 52/586.2 |
| 2,392,551 | * | 1/1946 | Roe | 52/586.2 |
| 2,423,695 | | 7/1947 | Falco . | |
| 2,711,096 | * | 6/1955 | Rouzaud | 52/585.1 |
| 3,170,267 | | 2/1965 | Rosenfeld . | |
| 3,585,752 | | 6/1971 | Howe . | |
| 3,609,926 | | 10/1971 | Muse . | |
| 3,640,039 | * | 2/1972 | McKee et al. | 52/586.2 |
| 3,680,277 | | 8/1972 | Martin . | |
| 3,693,307 | | 9/1972 | Muse . | |
| 3,780,484 | * | 12/1973 | Muse | 52/585.1 |
| 3,783,566 | | 1/1974 | Nielson . | |
| 3,855,752 | * | 12/1974 | Aylon | 52/605 |
| 3,864,885 | | 2/1975 | Muse . | |
| 3,936,987 | | 2/1976 | Calvin . | |
| 3,998,022 | | 12/1976 | Muse . | |
| 4,391,077 | * | 7/1983 | Giess | 52/586.2 |
| 4,833,856 | | 5/1989 | Zwagerman . | |
| 4,891,925 | | 1/1990 | Carlson et al. . | |
| 5,713,085 | * | 2/1998 | Enns | 52/586.2 |
| 5,934,039 | * | 8/1999 | Guy | 52/747.12 |
| 5,957,744 | * | 9/1999 | Mott et al. | 446/127 |

FOREIGN PATENT DOCUMENTS

| | | | | |
|---|---|---|---|---|
| 21733 | * | 10/1905 | (GB) | 52/582.1 |
| 484750 | * | 5/1938 | (GB) | 52/586.2 |
| 0568051 A1 | * | 11/1993 | (GB) | 52/582.1 |

* cited by examiner

*Primary Examiner*—Beth A. Stephan
*Assistant Examiner*—Dennis L. Dorsey
(74) *Attorney, Agent, or Firm*—Hamilton, Brook, Smith & Reynolds, PC

(57) ABSTRACT

The present invention is directed to a block system including first and second blocks. Each block has an outer surface with a pair of locking channels formed within the outer surface. The locking channels are spaced apart from each other. Each locking channel has a narrower outer slot portion extending through the outer surface and a wider inner slot portion extending from the outer slot portion into its respective block. A first pair of locking members are provided for coupling the blocks together by insertion into the locking channels of the blocks with the locking channels of the first block being positioned to join with the locking channels of the second block. The locking members have a cross-section with wider outer edges dimensioned to fit in the inner slot portions and a narrower mid-section dimensioned to fit in the outer slot portions.

17 Claims, 7 Drawing Sheets

MORTARLESS CONCRETE BLOCK

RELATED APPLICATIONS

This application claims priority to U.S. Provisional Application No. 60/090,438, filed on Jun. 24, 1998, and U.S. Provisional Application No. 60/099,144, filed on Sep. 4, 1998, the entire teachings of which are incorporated herein by reference.

BACKGROUND

Conventional concrete blocks have the advantages in construction of low material cost, durability, strength and simplicity. However, assembly into a useful wall requires considerable time, skill and almost continuous use of mortar. Workers must set each block on top of a bed of mortar, and then tap the block until the block is plumb, flush with the wall and at the correct height. Thus, block stacking is time-consuming and requires considerable training. Moreover, rain or subfreezing weather conditions can prevent proper curing of the mortar. Measures can be taken to allow construction in such weather conditions but can be economically unfeasible. As a result, work is usually suspended during adverse weather conditions.

Various attempts have been made to produce mortarless or dry-stack blocks where blocks are stacked to form walls with no intervening mortar in order to avoid the problems associated with the use of mortar. A problem with mortarless blocks is that conventional block making equipment cannot consistently manufacture blocks with height tolerances of less than 1/16 inch. In a block wall having a running bond pattern (each block resting on two blocks below), such height variations are too large for building stable mortarless walls. Typically, in conventional block walls, the mortar compensates for the height variations in the blocks. Most current mortarless blocks have designs which compensate for height variations but are either uneconomical to manufacture or require too much skill and time to assemble, thereby defeating the advantages of mortarless blocks.

SUMMARY OF THE INVENTION

The present invention is directed to a block system that does not require mortar and is economical to manufacture and assemble. The block system includes first and second blocks each having an outer surface with a first pair of locking channels formed within the outer surface. The locking channels are spaced apart from each other. Each locking channel has a narrower outer slot portion extending through the outer surface and a wider inner slot portion extending from the outer slot portion into its respective block. A first pair of locking members are provided for coupling the blocks together by insertion into the locking channels of the blocks with the locking channels of the first block being positioned to join with the locking channels of the second block. The locking members have a cross-section with wider outer edges dimensioned to fit in the inner slot portions and a narrower mid-section dimensioned to fit in the outer slot portions.

In preferred embodiments, the blocks are made of concrete and are rectangular with corners. Each locking channel is positioned close to a corner. The locking members have a continuous outer surface and are preferably solid with tapered ends. Each block further includes a second pair of locking channels. In one embodiment, the first and second pairs of locking channels are on opposite sides of the blocks. Each pair of locking channels are positioned on a web. The web is adjacent to a cavity extending through the block and is thicker near the locking channels. In another embodiment, the first and second pairs of locking channels are at right angles to each other. In addition, in another embodiment, a pair of locking passages extend through each block and are capable of engaging the locking members, thereby enabling the first and second blocks to be stacked in an offset manner.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

Figure 1:
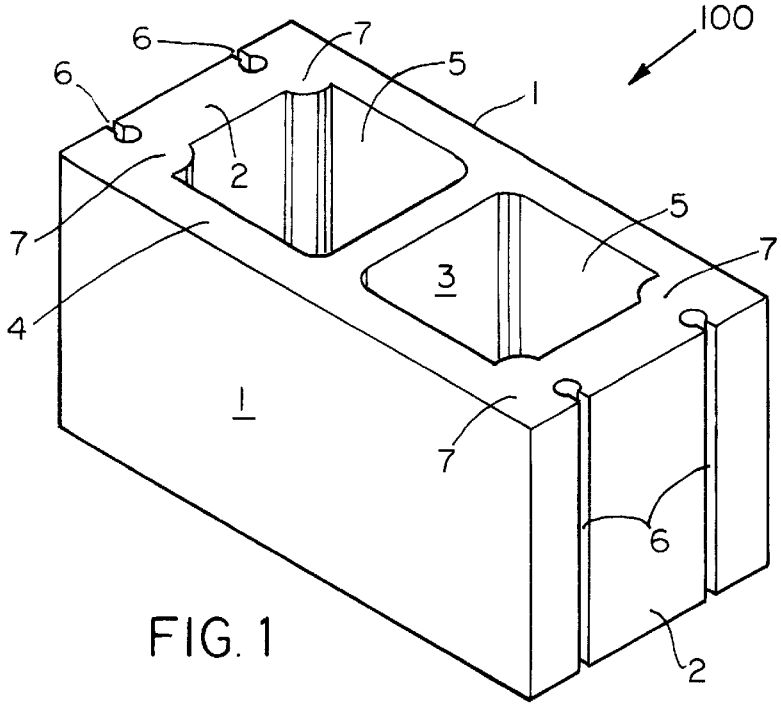
FIG. 1 is a perspective view of a preferred block of the present invention.

Referring to FIG. 1, block 100 is a molded concrete block consisting of two parallel concrete face shells 1 and two parallel end webs 2, which are perpendicular to face shells 1. Two cavities or cells 5 extend vertically through block 100 and are separated from each other by a center web 3 that is parallel to end webs 2. The face shells 1 and webs 2/3 surround cells 5. Each end web 2 has two locking channels or slots 6 running vertically up the outside face, each a short distance from the edges of web 2. In horizontal cross section, each slot 6 is wider some distance behind the outside surface of the web 2 than it is at the surface of the web 2. The web 2 is thicker in the areas 7 surrounding a slot 6 to maintain the strength in that area. In preferred embodiments, the height of the face shells 1 and the webs 2 (referred to as the "height of the block") is about 8 inches, and the length of the face shells 1 ("length of the block") is 16 inches. This contrasts with a conventional mortared block, where the corresponding dimensions are 7⅝ and 15⅝ inches, respectively.

Figure 2B:
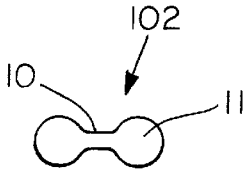
FIG. 2B is a top view of the fastener of FIG. 2A.
Figure 2A:
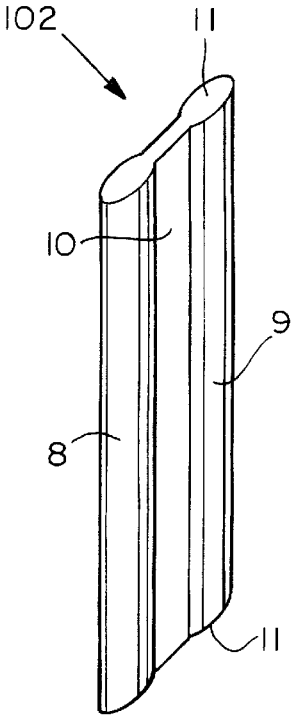
FIG. 2A is a perspective view of the locking member or fastener for securing the blocks together.
Figure 2C:
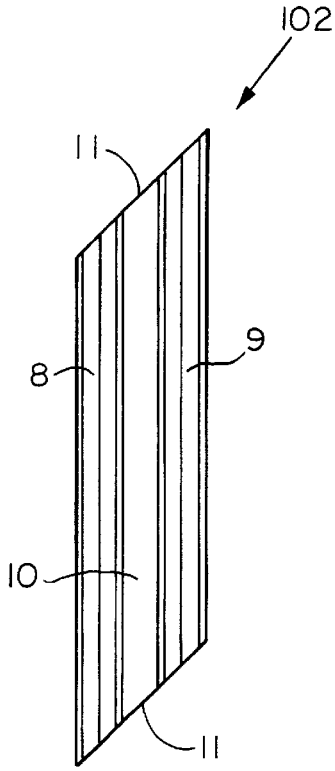
FIG. 2C is a side view of the fastener of FIG. 2A.

Referring to FIGS. 2A, 2B and 2C, fastener or locking member 102 is employed for locking blocks 100 together. Fastener 102 is preferably a solid plastic elongate member with a cross-section consisting of two rounded sections 8 and 9 connected by a thinner mid-section 10. The resulting cross-section approximates a figure eight. The top and bottom surfaces 11 are angled from the outside edge of one rounded section 8 to the outside edge of the other rounded section 9. Surfaces 11 are angled to be parallel to one another. The angled surfaces 11 allow for easier insertion of fasteners 102 into slots 6 and also serve to lock vertically adjacent fasteners 102 together. The length of fasteners 102 is about the same as the height of block 100. Although fastener 102 is preferably plastic, fastener 102 can also be made of steel.

Figure 3:
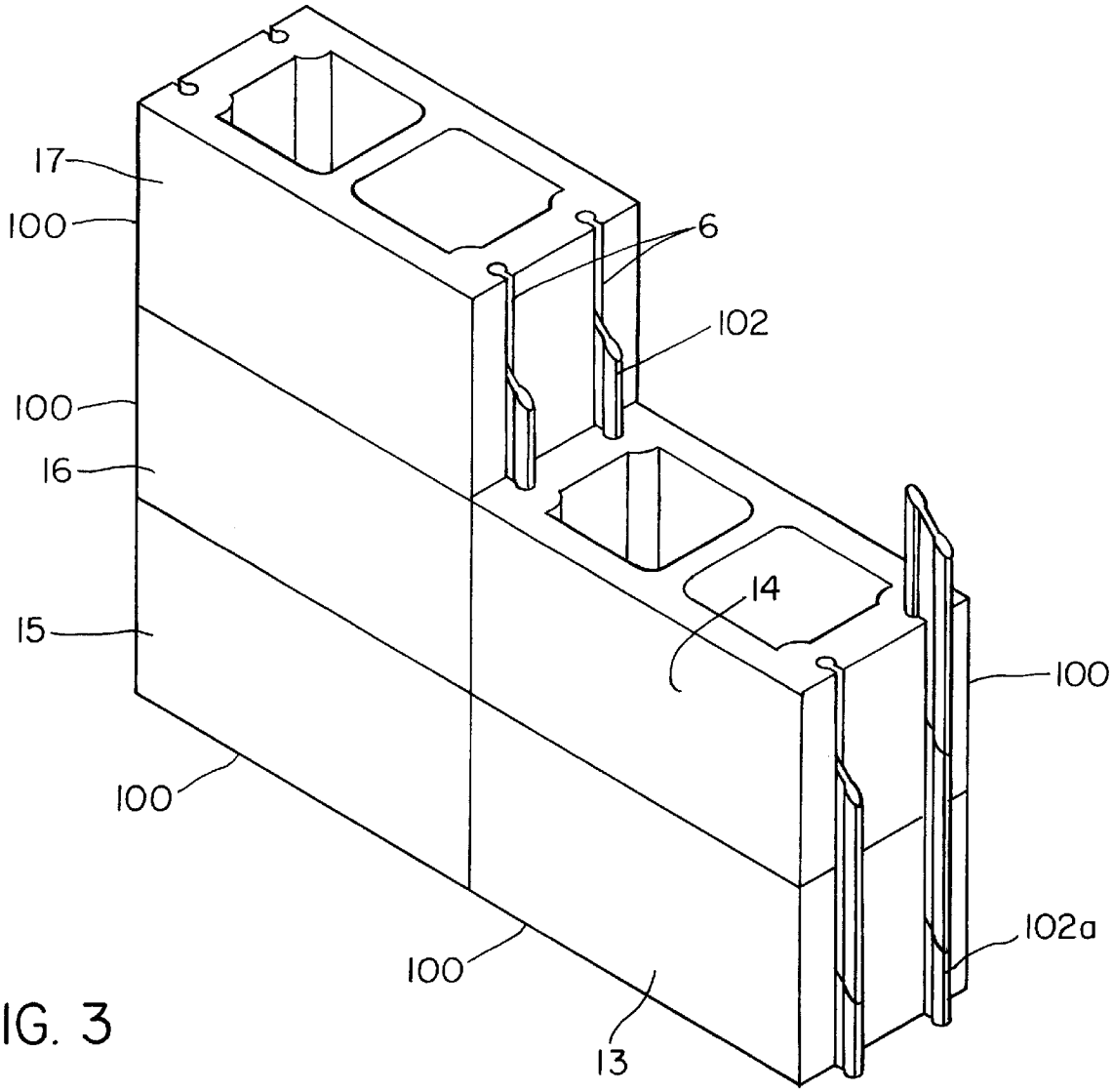
FIG. 3 is a perspective view of a partially assembled wall.

Referring to FIG. 3, the preferred pattern for stacking blocks 100 into a wall includes placing the blocks 100 in adjacent abutting vertical courses such as (15, 16, 17) and (13, 14). A series of fasteners 102 are inserted end to end within mating slots 6 so that in central areas of the wall, each fastener 102 simultaneously engages the slots 6 of both horizontally and vertically adjacent blocks 100, for example, blocks 16, 17 and 14. Fastener 102 is shaped so that it fits precisely into the space defined between two slots 6 of abutting blocks 100 placed end to end to lock the blocks 100 together. Since the slots 6 are wider at points away from the surface of the ends of the blocks 100 than they are at the surface, the fasteners 102 can only be pulled out of the slots 6 horizontally with a pulling force sufficient to break the block 100 or deform the fastener 6. Each fastener 102 is inserted within slots 6 in a manner where approximately half of its height is situated in the slots 6 of two vertically adjacent blocks 100 such as in blocks 13 and 14. To make this possible, the bottom fasteners 102 within the bottom blocks 100 are cut to half their length.

Thus, during construction, the workers set the first course of blocks 100 and then insert fasteners 102*a* that are cut to half of their length into slots 6. A second set of fasteners 102 are then inserted into slot 6 so that the final set of fasteners 102 protrude upward from the tops of the blocks 100 by approximately half their length (about 4 inches). The second course of blocks 100 can then be set with the slots 6 engaging the protruding fasteners 102. The process of inserting fasteners 102 and setting blocks continues until the wall is completed. As can be seen, each fastener 102 overlaps the joints between vertically adjacent blocks 100. In addition, the slots 6 of horizontally adjacent blocks 100 are locked in face-to-face relation by fasteners 102, with about half the cross-section of fastener 102 being in the slot 6 of each block 100. Although fasteners 102 are preferably about the height of block 100, alternatively, it is possible to use special fasteners 102 which are about 1½ times the normal length (about 12 inches).

Vertical stacking of blocks 100 avoids the height variation problem between blocks 100 encountered in a running bond pattern. The use of paired fasteners 102 between adjacent blocks 100 enforces straight alignment of the wall between horizontally adjacent blocks 100. The placement of the slots 6 near the edges of blocks 100 allows the center of the webs to be reduced in height if desired to accommodate reinforcement or insulation.

Figure 4:
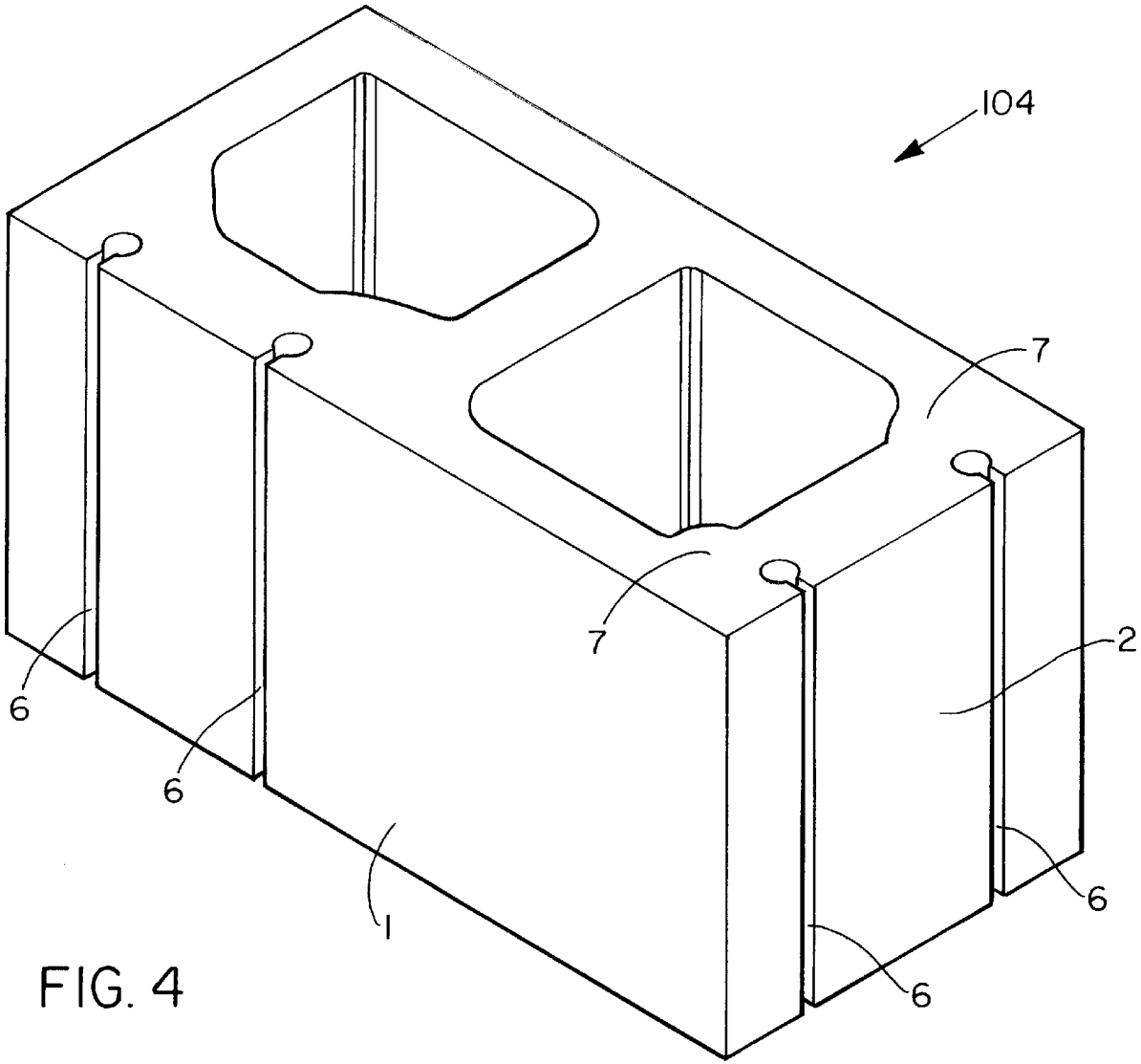
FIG. 4 is a perspective view of a preferred corner block.

Referring to FIG. 4, corner block 104 is a preferred block for use at the corners of walls and includes slots 6 on only one end web 2. Two slots 6 are positioned on a face shell 1 at a right angle to the slots 6 on web 2 and are dimensioned the same as the slots 6 on the end web 2. This allows two blocks 100 to be connected to web 2 and face shell 1 of corner block 104 at right angles to each other.

Figure 5:
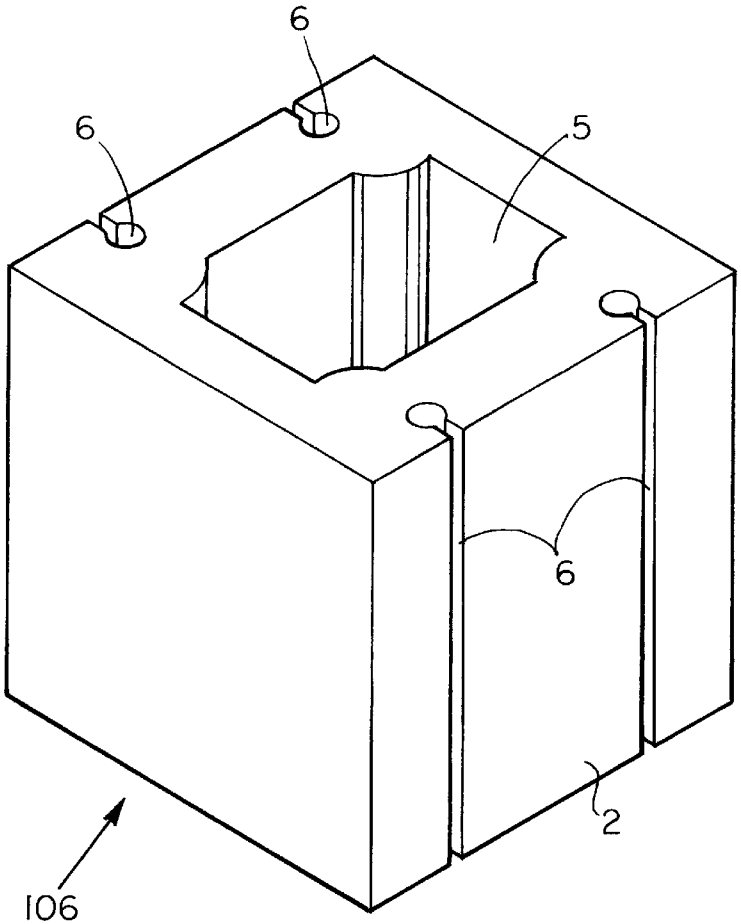
FIG. 5 is a perspective view of a preferred half block.

Referring to FIG. 5, half block 106 is a preferred half block which differs from block 100 in that half block 106 is 8 inches long instead of 16 inches. In addition, half block 106 has only one cell 5 and no center web 3. Half block 106 allows the length of walls to be built to the closest 8 inches instead of the closest 16 inches.

Figures 6A, 6B, 6C, 6D, 6E:
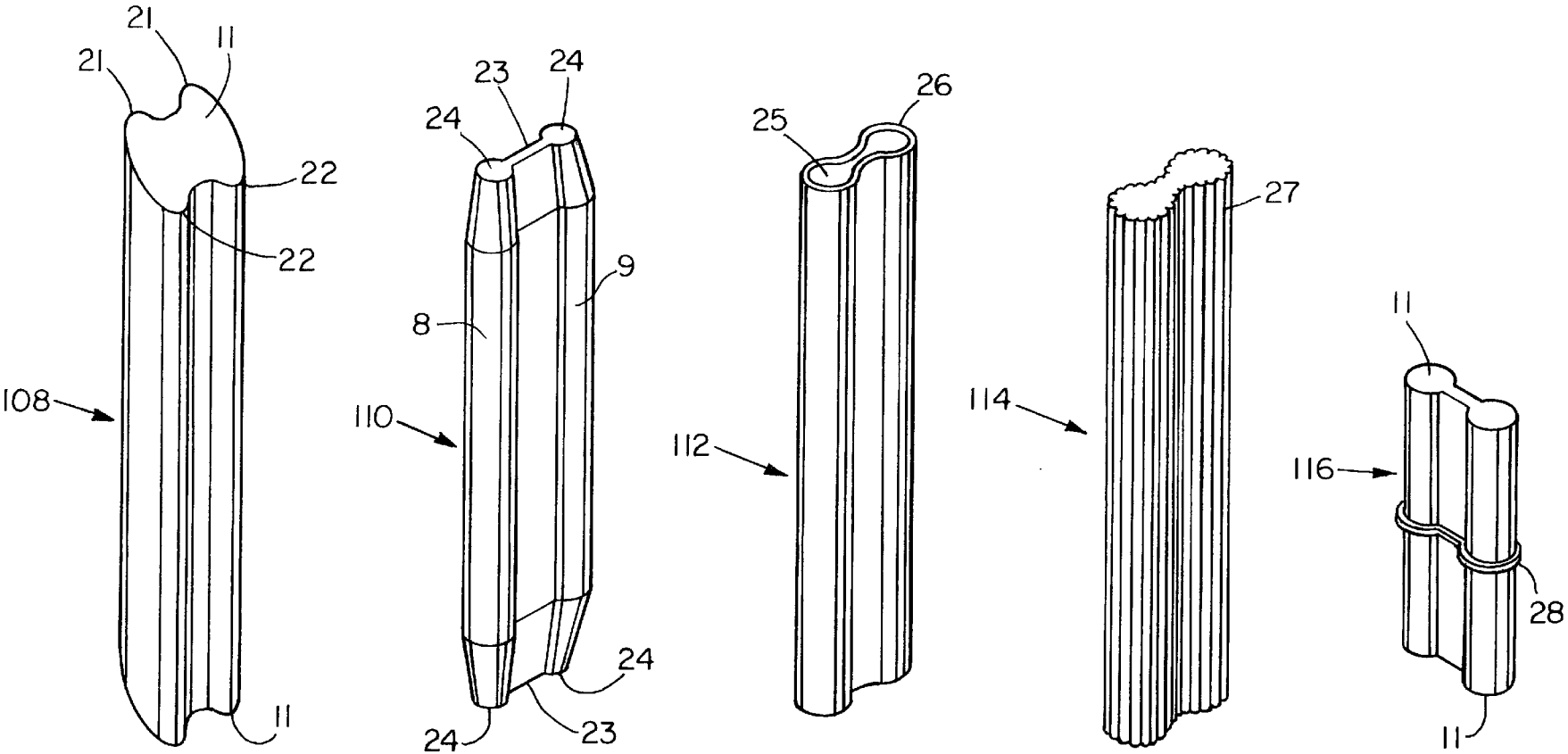
FIG. 6A is a perspective view of another preferred fastener with the ends cut diagonally side-to-side.
FIG. 6B is a perspective view of still another preferred fastener with the ends tapered toward the center.
FIG. 6C is a perspective view of a preferred hollow fastener.
FIG. 6D is a perspective view of another preferred fastener having a ribbed vertical surface.
FIG. 6E is a perspective view of a preferred short fastener with a raised area around the exterior surface half way up the length of the fastener.

Referring to FIG. 6A, fastener 108 is another preferred fastener and has ends 11 that are sloped at an angle from the extreme points 21 on one side of the surface of the end 11 to the extreme points 22 on the other side. Fastener 108 is cut at an angle at each end that is perpendicular to that shown for fastener 102. Thus the highest point of the fastener 108 at an end would occur to the extreme left (or right) of the figure eight, and the lowest point would occur at the extreme right (or left).

Referring to FIG. 6B, fastener 110 is another preferred fastener which has ends 23 tapered to points 24, with one point 24 at the end of each rounded section 8 and 9. As a result, each end of fastener 110 has a pair of points.

Referring to FIG. 6C, fastener 112 is another preferred fastener with a hollow 25 having a constant horizontal cross section and the wall of material 26 around the hollow 25 being of approximately constant thickness. The hollow 25 increases the flexibility of fastener 112 for insertion purposes.

Referring to FIG. 6D, fastener 114 is another preferred fastener and has a modified horizontal cross section such that the entire vertical surface consists of a series of vertical ribs 27 which can make fastener 114 slide into slots 6 more easily.

Referring to FIG. 6E, fastener 116 is another preferred fastener which is shorter than the height of block 100. Fastener 116 includes a raised portion 28 around the outside of the fastener 116 approximately equidistant from either end 11, at which the horizontal cross section of the fastener is somewhat greater in all directions. Preferably fastener 116 is shorter than eight inches long and it is slightly wider halfway up its height, for example from a raised band running around the outside. The reduced height makes the connection of fastener 116 and block 100 easier. The raised surface holds the fastener 116 securely so that half of its length can protrude downward into the block 100 below and the other half can protrude upward into the block 100 above.

Figure 7A:
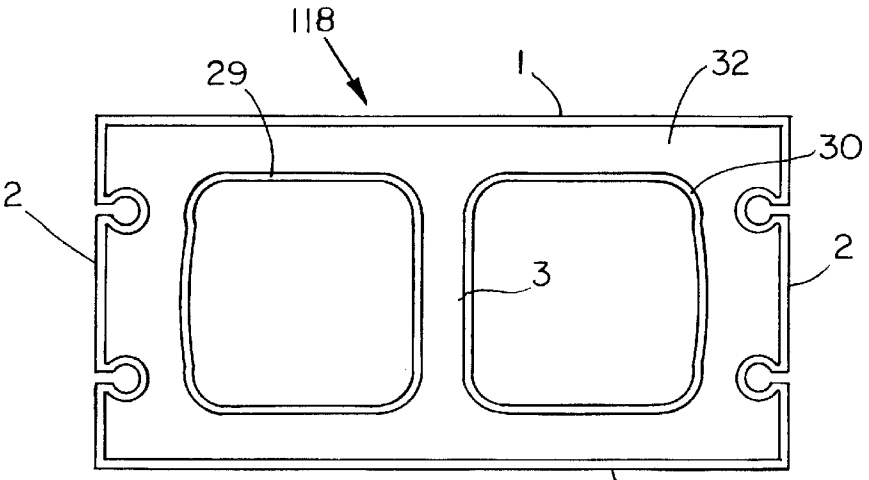
FIG. 7A is a top view of a preferred block with notched edges along the top surface.
Figure 7B:
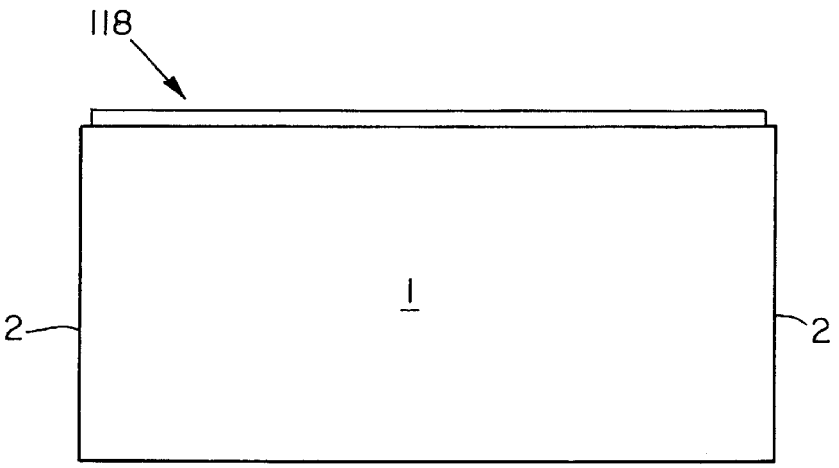
FIG. 7B is a side view of the block of FIG. 7A.

Referring to FIGS. 7A and 7B, block 118 is another preferred block which differs from block 100 in that block 118 includes a notch 29 along the interior and exterior of the top surface of the block 118. The resulting depressed edging around the perimeters of the top surface of the block reduces the probability of imperfections along the edges that might make the top surface uneven and therefore make a stacked wall less stable. In addition, the depressions surrounding each slot 6 provides space for a raised surface around the shaft of a fastener 116.

Figure 8:
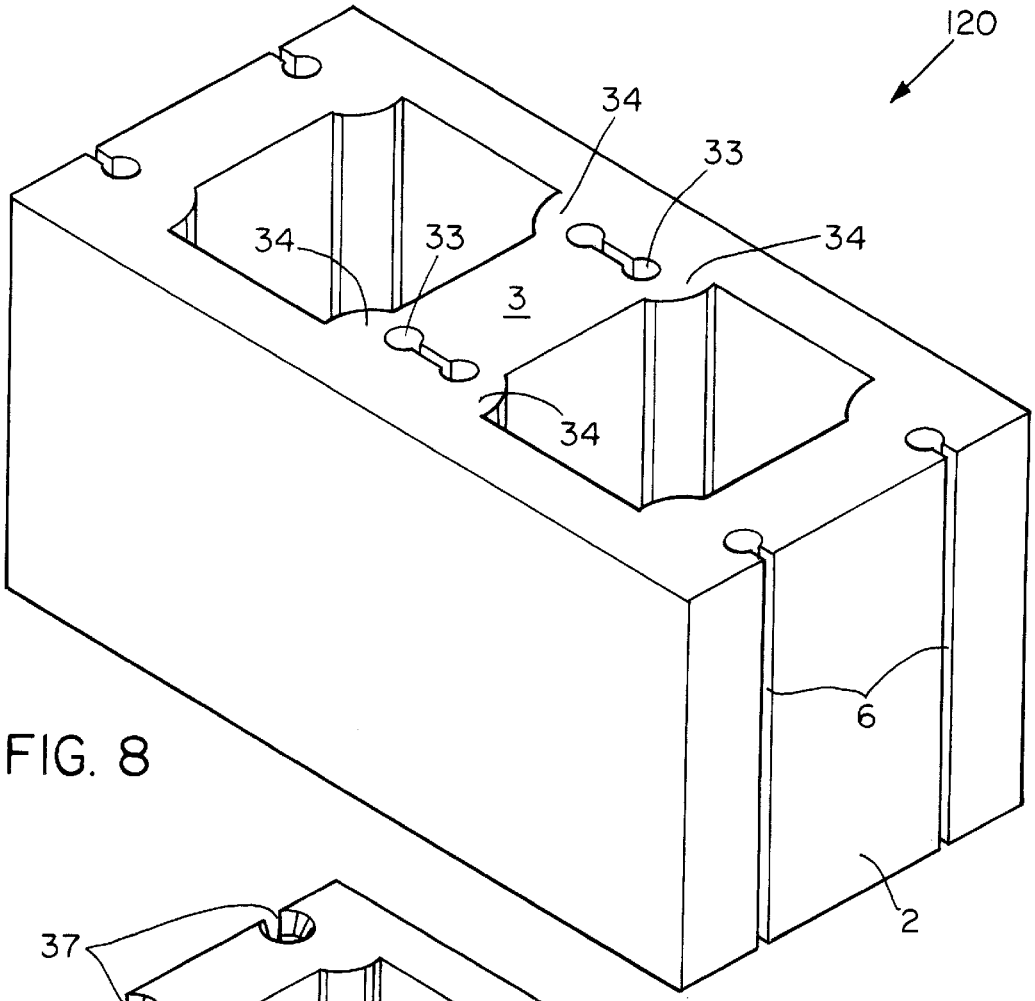
FIG. 8 is a perspective view of a preferred block with vertical locking holes extending through the center web.
Figure 9:
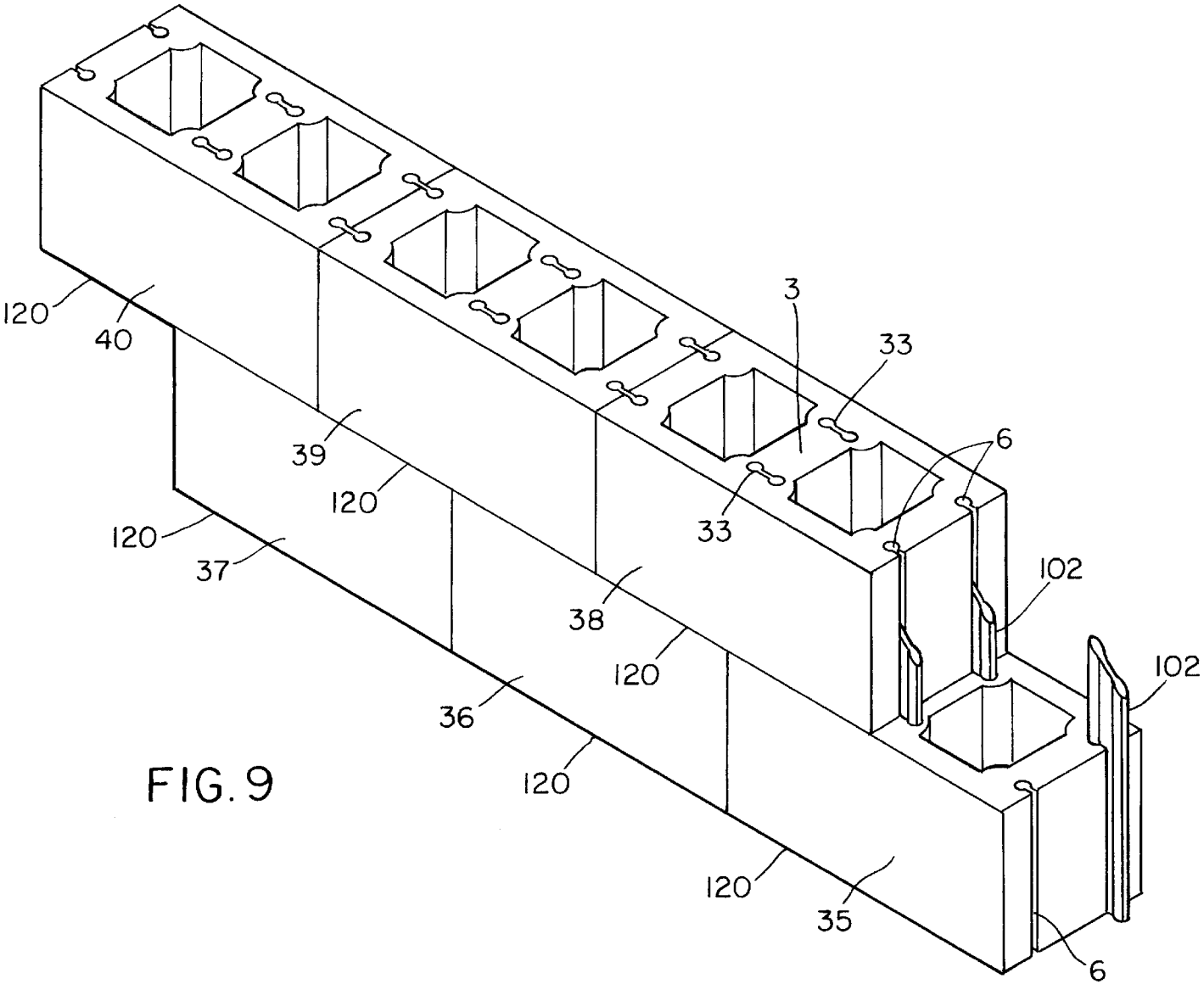
FIG. 9 is a perspective view of a partially assembled wall constructed of the blocks of FIG. 8.

Referring to FIGS. 8 and 9, block 120 is another preferred block which differs from block 100 in that block 120 contains vertical locking holes 33 extending through the center web 3 with a constant cross section similar to fastener 102 for engaging fastener 102. Vertical holes 33 are midway between slots 6 in webs 2 and have the same spacing between holes 33 and slots 6. The center web 3 is also thicker in the areas 34 to either side of the holes 33.

Locking holes 33 in the center web 3 allow the block 120 to be stacked in a running bond. Each hole 33 aligns with a pair of abutting slots 6 in the two blocks 120 below, and in two blocks 120 above. Fasteners 102 span the pair of slots 6 below (or above) and a hole 33 in a center web 3 above (or below). In the preferred pattern, the blocks comprising one course, such as 35, 36, and 37 are offset horizontally from the blocks, such as 38, 39, and 40, comprising the course below or above by the length of one-half block. The fasteners, therefore protrude halfway down (or up) into the cavity formed by the adjacent slots of two abutting blocks, such as 35 and 36, on the same course, and protrude halfway up (or down) into the hole 33 of the block, such as 38, on the course above (or below) that spans the other two blocks on the adjacent course.

Figure 10:
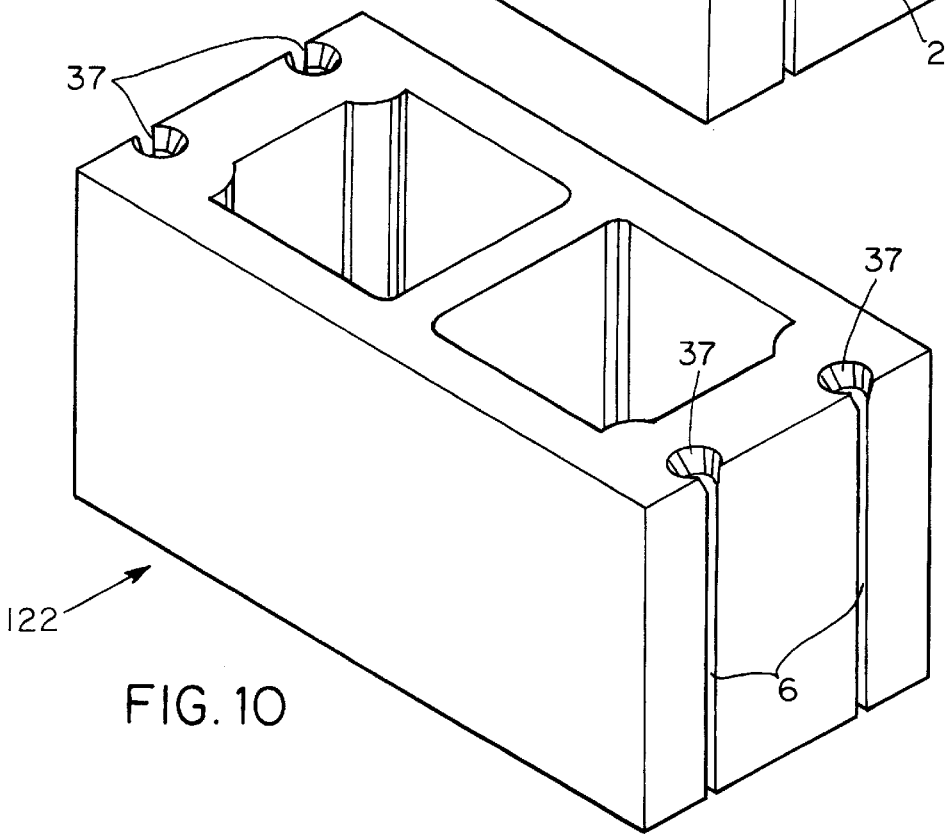
FIG. 10 is a perspective view of a preferred block with slots that widen as they approach the top of the block.

Referring to FIG. 10, block 122 is another preferred block which differs from block 100 in that block 122 includes slots 6 with cross sections that become gradually wider near the top of the block, creating approximately funnel-shaped portions 37 of the slots 6. The funnel 37 in the top of the slot 6 makes it easier to insert fasteners into the slots 6 or, if the block 122 were turned upside down, set the block 122 over protruding fasteners below.

Although specific dimensions have been given for blocks 100, 104, 106, 118, 120 and 122, as well as fasteners 102, 108, 110, 112, 114 and 116, those dimensions can be varied accordingly to accommodate different applications. Although the material for the blocks is preferably concrete, the materials for all parts can be made from any suitable materials such as any plastic, metal, plastic composite, or concrete with unconventional aggregates.

EQUIVALENTS

While this invention has been particularly shown and described with references to preferred embodiments thereof, it will be understood by those skilled in the art that various changes in form and details may be made therein without departing from the spirit and scope of the invention as defined by the appended claims.

For example, the cross sections of the slots and fasteners can be any of various shapes so long as the fasteners have greater dimensions off their cross sectional center, and the slots have shapes that mate on at least some surfaces with the fasteners. Analogous slots may be applied to almost any of the common variations on the conventional concrete block (beyond the corner block and half block already described) to use for special situations in stacking a mortarless wall joined by the fasteners, including, but not limited to, a half-high block, a bond beam block, an end block, a jamb block, a sash block, a splittable block, blocks of different thicknesses, a reduced-web insulated block, and almost any variety of architectural block.

What is claimed is:

1. A block system comprising:

a series of rectangular masonry blocks each with two sides and two ends, the blocks each having an outer surface with a first pair of locking channels formed within the outer surface at one end thereof and spaced apart from each other, each locking channel having a length with a narrower outer slot portion extending through the outer surface and a wider inner slot portion extending from the outer slot portion into the respective block; and a series of locking members for coupling the blocks together by insertion into the locking channels of the blocks with the locking channels of the blocks being positioned to join with each other, the locking members having a continuous outer surface, a cross-section with wider outer edges dimensioned to fit in the inner slot portions and a narrower mid-section dimensioned to fit in the outer slot portions, the locking members capable of being positioned end to end within the entire length of the locking channels of vertically adjacent blocks, each locking member being sized for extending between said vertically adjacent blocks and terminating about midway through a block, the ends of the locking members being sloped for locking vertically adjacent locking members together.

2. The block system of claim 1 in which the locking members are solid.

3. The block system of claim 1 in which the locking channels have flared entrances for facilitating insertion of the locking members.

4. The block system of claim 1 in which the blocks each have a surface with recessed edges.

5. The block system of claim 1 in which the locking members have pointed ends.

6. The block system of claim 5 in which the pointed ends are formed by cutting the ends of the locking members at a sloped angle.

7. The block system of claim 1 in which the blocks have corners, each locking channel of the first pair of locking channels being positioned close to a corner.

8. The block system of claim 7 in which each block further comprises a second pair of locking channels.

9. The block system of claim 8 in which the first and second pairs of locking channels are at right angles to each other.

10. The block system of claim 8 in which each pair of locking channels are positioned on a web, the web being adjacent to a cavity, the web being thicker near the locking channels.

11. The block system of claim 8 in which the first and second pairs of locking channels are on opposite ends of the blocks.

12. The block system of claim 11 in which each block further comprises a pair of locking passages extending through the block capable of engaging the locking members for enabling the blocks to be stacked in an offset manner.

13. A concrete block system comprising:

a series of rectangular concrete blocks each with two sides and two ends, the blocks each having an outer surface with corners and a first pair of locking channels formed within the outer surface at one end thereof and spaced apart from each other, each locking channel being positioned close to a corner and having a length with a narrower outer slot portion extending through the outer surface and a wider inner slot portion extending from the outer slot portion into the respective block; and a series of locking members for coupling the blocks together by insertion into the locking channels of the blocks with the locking channels of the blocks being positioned to join with each other, the locking members heaving a cross-section with wider outer edges dimensioned to fit in the inner slot portions and a narrower mid-section dimensioned to fit in the outer slot portions, the locking members capable of coupling the blocks horizontally and vertically adjacent to each other, the locking members also capable of being positioned end to end within the entire length of the locking channels of vertically adjacent blocks, each locking member being sized for extending between said vertically adjacent blocks and terminating about midway through a block, the locking channels having flared funnel shaped entrances for facilitating insertion of the locking members.

14. A method of coupling a series of rectangular masonry blocks together, each block having an outer surface, two sides and two ends, the method comprising the steps of:

forming a first pair of locking channels within the outer surface at one end thereof of each block, the locking channels being spaced apart from each other, each locking channel having a length with a narrower outer slot portion extending through the outer surface and a wider inner slot portion extending from the outer slot portion into the respective block;

positioning the blocks adjacent to each other to join the locking channels of the blocks together; and inserting a series of locking members into the joined locking channels of the blocks to couple the blocks together, the locking members having a continuous outer surfaces, a cross-section with wider outer edges dimensioned to fit in the inner slot portions and a narrower mid-section dimensioned to fit in the outer slot portions, the entire outer surface having a series of vertical ribs, the locking members capable of being positioned end to end within the entire length of the locking channels of vertically adjacent blocks, each locking member being sized for extending between said vertically adjacent blocks and terminating about midway through a block.

15. The method of claim 14 in which the blocks are rectangular with corners, the method further comprising the step of positioning each locking channel close to a corner.

16. The method of claim 14 further comprising the step of providing each block with a second pair of locking channels.

17. The method of claim 16 further comprising the step of positioning the first and second pairs of locking channels on opposite sides of the blocks.

* * * * *